US011121445B2

(12) United States Patent
Doumanis et al.

(10) Patent No.: US 11,121,445 B2
(45) Date of Patent: Sep. 14, 2021

(54) RESONATOR FOR RADIO FREQUENCY SIGNALS

(71) Applicant: Nokia Solutions and Networks Oy, Espoo (FI)

(72) Inventors: Efstratios Doumanis, Helsinki (FI); Murat Emre Ermutlu, Helsinki (FI); Juha Olli Jokilahti, Lahti (FI)

(73) Assignee: Nokia Solutions and Networks OY, Espoo (FI)

( * ) Notice: Subject to any disclaimer, the term of this patent is extended or adjusted under 35 U.S.C. 154(b) by 1 day.

(21) Appl. No.: 16/695,871

(22) Filed: Nov. 26, 2019

(65) Prior Publication Data

US 2020/0176850 A1 Jun. 4, 2020

(30) Foreign Application Priority Data

Nov. 30, 2018 (EP) ..... 18209445

(51) Int. Cl.

| | |
|---|---|
| ***H01P 7/06*** | (2006.01) |
| ***H01P 1/208*** | (2006.01) |
| ***H01P 1/06*** | (2006.01) |
| ***H01P 1/207*** | (2006.01) |

(52) U.S. Cl.

CPC ..... *H01P 7/06* (2013.01); *H01P 1/061* (2013.01); *H01P 1/207* (2013.01)

(58) Field of Classification Search

CPC ..... H01P 7/06; H01P 1/207; H01P 1/208

See application file for complete search history.

(56) References Cited

U.S. PATENT DOCUMENTS

| | | | | |
|---|---|---|---|---|
| 4,700,127 | A | 10/1987 | Sasaki et al. | |
| 6,118,356 | A * | 9/2000 | Loi | H01P 7/06 333/209 |
| 7,012,488 | B2 * | 3/2006 | Beis | H01P 7/06 333/231 |
| 8,072,298 | B2 | 12/2011 | Kim et al. | |
| 2002/0180559 | A1 | 12/2002 | Jang | |
| 2003/0102943 | A1 | 6/2003 | Beis et al. | |
| 2005/0212623 | A1 | 9/2005 | Ala-Kojola | |
| 2007/0164841 | A1 * | 7/2007 | Juang | H01P 1/20381 333/205 |

(Continued)

FOREIGN PATENT DOCUMENTS

| | | | |
|---|---|---|---|
| CN | 1416605 | 5/2003 | H01P 7/06 |
| CN | 1416605 A | 5/2003 | |

(Continued)

OTHER PUBLICATIONS

Raafat R.Mansour, "High-Q Tunable Dielectric Resonator Filters", IEEE Microwave Magazine, vol. 10, No. 6, Oct. 2009, pp. 84-98.

(Continued)

*Primary Examiner* — Dean O Takaoka

(74) *Attorney, Agent, or Firm* — Mendelsohn Dunleavy, P.C.; Yuri Gruzdkov

(57) ABSTRACT

A resonator for radio frequency, RF, signals, said resonator comprising a cavity having a longitudinal axis, a first wall, at least one side wall, and a lid arranged opposite the first wall, wherein said resonator further comprises a guiding device which is arranged at said at least one side wall and is configured to guide an axial movement of said lid along said longitudinal axis.

10 Claims, 8 Drawing Sheets

(56) References Cited

U.S. PATENT DOCUMENTS

| | | | | |
|---|---|---|---|---|
| 2008/0129422 | A1 | 6/2008 | Alford et al. | |
| 2011/0298566 | A1* | 12/2011 | Yassini | H01P 7/06 333/202 |
| 2012/0007697 | A1 | 1/2012 | Tiihonen | |
| 2012/0019337 | A1 | 1/2012 | Wong | |
| 2012/0119850 | A1 | 5/2012 | Päri et al. | |
| 2012/0119851 | A1 | 5/2012 | Päri et al. | |
| 2015/0061792 | A1 | 3/2015 | Chun | |
| 2017/0237143 | A1 | 8/2017 | Chan | |

FOREIGN PATENT DOCUMENTS

| | | | | |
|---|---|---|---|---|
| CN | 105070987 | | 11/2015 | H01P 1/203 |
| CN | 105070987 | A | 11/2015 | |
| CN | 206864600 | | 1/2018 | H01P 5/12 |
| CN | 206864600 | U | 1/2018 | |
| CN | 208111649 | | 11/2018 | H01P 1/207 |
| CN | 208111649 | U | 11/2018 | |
| EP | 3104453 | | 12/2016 | H01P 7/04 |
| EP | 3104453 | A1 | 12/2016 | |
| GB | 2548474 | A | 9/2017 | |

OTHER PUBLICATIONS

Fengxi Huang "High Q Tunable Filters", Thesis, Ontario, Canada, 2012, 161 pages.

Extended European Search Report received for corresponding European Patent Application No. 18209445.8, dated May 27, 2019, 7 pages.

First Office Action for corresponding Chinese application No. 2019112049613; dated Mar. 9, 2021 (13 pages) Machine Translation.

Communication pursuant to Article 94(3) EPC for corresponding European application No. 18209445.8; dated Jul. 19, 2021 (7 pages).

* cited by examiner

RESONATOR FOR RADIO FREQUENCY SIGNALS

RELATED APPLICATION

This application claims priority benefit from European Patent Application No. 18209445.8 filed Nov. 30, 2018 the content of which is hereby incorporated by reference in its entirety.

FIELD OF THE INVENTION

Exemplary embodiments relate to a resonator for radio frequency, RF, signals.

Further exemplary embodiments relate to a filter for RF signals.

Further exemplary embodiments relate to a method of filtering RF signals.

BACKGROUND

Resonators for RF signals may be used to provide filters for RF signals.

SUMMARY

Exemplary embodiments relate to a resonator for radio frequency, RF, signals, said resonator comprising a cavity having a longitudinal axis, a first wall, at least one side wall, and a lid arranged opposite the first wall, wherein said resonator further comprises a guiding device which is arranged at said at least one side wall and is configured to guide an axial movement of said lid along said longitudinal axis. This enables an efficient tuning of the resonator, particularly of a resonant frequency of said resonator. Thus, no further, separate tuning elements as known from conventional systems are required for tuning said resonator.

According to further exemplary embodiments, said first wall may be a bottom wall of the resonator, and/or said lid may be a top wall of the resonator.

According to further exemplary embodiments, said cavity may comprise a rectangular cross-section. According to further exemplary embodiments, said cavity may comprise a circular cross-section.

According to further exemplary embodiments, said guiding device comprises a first thread, preferably an internal (i.e., female) thread, and said lid comprises a second thread, preferably an external (i.e., male) thread that fits to said first thread of said guiding device. Thus, a precise tuning of the resonator's resonant frequency is enabled by rotating said lid within the guiding device. In these embodiments, the guiding device is configured to guide both a rotational movement and said axial movement of the lid with respect to the resonator's cavity.

According to further exemplary embodiments, said guiding device comprises a first serrated surface, and said lid comprises a second serrated surface that fits to said first serrated surface of said guiding device. This enables a stepwise axial movement of said lid relative to said cavity, i.e. without rotation of said lid. According to further exemplary embodiments, the serrated surfaces may be provided in the form of a "step slide", or generally by any structure enabling—at least to some extent—form closure between the lid and the side wall(s) to retain the lid in its place in the absence of external forces. However, if an external force is applied, e.g. in an axial direction, said force exceeding a predetermined threshold (e.g. the retention force of the form closure), the lid may be moved axially to effect tuning.

According to further exemplary embodiments, a step size of said stepwise axial movement (and/or a force required to effect said movement, i.e. to at least temporarily overcome said form closure) may be controlled by providing the serrated surfaces with a corresponding geometry. According to further exemplary embodiments, guiding means comprising said serrated surfaces may be used with rectangular and/or circular cross-section of said cavity, while according to other exemplary embodiments guiding means comprising threads are preferably used with a circular cross-section of said cavity.

According to further exemplary embodiments, said guiding device is arranged in a first axial end section of said cavity (having rectangular or circular cross-section, e.g.), and said first wall (for example, bottom wall) is arranged in a second axial end section of said side wall.

According to further exemplary embodiments, said first wall comprises at least one resonator post extending into said cavity (preferably perpendicular to an inner surface of said first wall). According to further exemplary embodiments, said at least one resonator post comprises a circular cylindrical shape. According to further exemplary embodiments, said at least one resonator post comprises a hollow (circular) cylindrical shape. According to further exemplary embodiments, said at least one resonator post is arranged coaxially with respect to the longitudinal axis of the cavity.

According to further exemplary embodiments, said lid comprises at least one resonator post extending into said cavity, preferably perpendicular to an inner surface of said lid. According to further exemplary embodiments, said at least one resonator post of said lid comprises a circular cylindrical shape. According to further exemplary embodiments, said at least one resonator post comprises a hollow (circular) cylindrical shape.

According to further exemplary embodiments, said at least one resonator post is arranged coaxially with respect to the longitudinal axis of the cavity and/or an optional resonator post extending from said first wall into said cavity.

According to further exemplary embodiments, said first wall comprises at least one opening, which enables to exchange RF signals and/or generally electromagnetic energy with an adjacent volume such as an optional neighboring further resonator and/or any other component or system configured to be coupled to said resonator. According to further exemplary embodiments, said at least one opening of said first wall comprises a circular (and/or circular ring) shape, preferably arranged coaxially with the longitudinal axis of the cavity of said resonator. According to further exemplary embodiments, a plurality of openings may be provided in said first wall, wherein preferably said plurality of openings is arranged circumferentially around said longitudinal axis of the cavity. According to further exemplary embodiments, at least one of said plurality of openings may comprise a rectangular shape, preferably with rounded edges.

According to further embodiments, said at least one lid comprises a profile, e.g. screw profile, for example a hexagonal profile, e.g. similar to a hex nut, which facilitates driving a rotational movement of said lid, e.g. for tuning the resonator cavity associated with said lid. According to further embodiments, said profile is provided on a surface of said lid, preferably an outer surface of said lid, to enable easy access from the outside of the resonator.

Further exemplary embodiments relate to an apparatus comprising a first resonator according to at least one of the preceding claims and at least one further resonator for radio frequency, RF, signals which is preferably coupled with said first resonator. This way, a compact and mechanically stable configuration having two resonators may be provided, wherein at least the first resonator is efficiently tunable regarding its resonant frequency by means of at least axially moving its lid.

According to further exemplary embodiments, said at least one further resonator of said apparatus may be a resonator according to the embodiments. This way, a compact and mechanically stable configuration having two resonators may be provided, wherein at least the first resonator and the further resonator are efficiently tunable regarding their resonant frequency by means of at least axially moving the respective lid.

According to further exemplary embodiments, said at least one further resonator may be a conventional resonator. According to further exemplary embodiments, said first resonator and said at least one further resonator (or their respective cavities) are not coupled with each other.

According to further exemplary embodiments, said at least one further resonator is a second resonator, wherein said second resonator comprises a configuration according to the embodiments. I.e., according to further exemplary embodiments, said second resonator comprises a cavity having a longitudinal axis, a first wall, at least one side wall, and a lid arranged opposite the first wall, wherein said second resonator further comprises a guiding device which is arranged at said at least one side wall and is configured to guide an axial movement of said lid along said longitudinal axis (preferably at least an axial movement, in case of e.g. serrated surfaces, and both a rotational and an axial movement in case of a thread connection between the guiding device and the lid).

According to further exemplary embodiments, the first wall of the first resonator and the first wall of the second resonator are adjacent to each other forming a common wall which at least partly (e.g., apart from one or more optional openings for RF signal coupling) separates the cavity of the first resonator and the cavity of the second resonator from each other, wherein preferably said common wall comprises at least one opening. This enables a particularly small configuration of the apparatus, which may also be referred to as "stacked configuration", because the first resonator and the second resonator may be arranged together along the longitudinal axis of their cavities. According to further exemplary embodiments, the first resonator and the second resonator are arranged relative to each other such that the longitudinal axes of their respective cavities are collinear.

According to further exemplary embodiments, said at least one opening of said common wall comprises a circular (and/or circular ring) shape, preferably arranged coaxial with the longitudinal axis of at least one adjacent cavity. According to further exemplary embodiments, a plurality of openings may be provided in said common wall, wherein preferably said plurality of openings is arranged circumferentially around the longitudinal axis of said at least one adjacent cavity. According to further exemplary embodiments, at least one of said plurality of openings may comprise a rectangular shape, preferably with rounded edges.

According to further exemplary embodiments, the cavity of the first resonator may have a first geometry, e.g. particular cross-section (shape and/or size), and the cavity of the second resonator may have a second geometry, e.g. particular cross-section, wherein said second geometry is different from said first geometry. According to further exemplary embodiments, the second geometry may be similar or identical to the first geometry.

According to further exemplary embodiments, said at least one side wall of the first resonator and said at least one side wall of the second resonator are made of one piece forming a common side wall for both said first cavity and said second cavity, which yields a particularly compact configuration with high mechanical stability.

According to further exemplary embodiments, said common wall and said common side wall are made of one piece.

According to further exemplary embodiments, a third resonator with a cavity is provided, wherein said third resonator comprises at least one side wall and is arranged such that a first axial end section of its cavity faces a first axial end section of the cavity of the second resonator, wherein a common lid is provided between the second resonator and the third resonator, said common lid at least partly, preferably fully, covering the cavity of the second resonator and the cavity of the third resonator. This way, a compact and mechanically stable configuration having three resonators may be provided, wherein at least the first resonator is efficiently tunable regarding its resonant frequency by means of at least axially moving its lid.

According to further exemplary embodiments, said apparatus further comprises a fourth resonator with a cavity, a first wall, and at least one side wall, wherein a first wall of the third resonator and the first wall of the fourth resonator are adjacent to each other forming a further common wall which at least partly (e.g., apart from one or more optional openings for RF signal coupling) separates the cavity of the third resonator and the cavity of the fourth resonator from each other. This way, a compact and mechanically stable configuration having four resonators may be provided, wherein at least the first resonator and/or the further resonator are efficiently tunable regarding their resonant frequency by means of at least axially moving their respective lid.

According to further exemplary embodiments, the shape of said fourth resonator is similar or identical to the shape of the first and/or second resonator. As an example, the fourth resonator may also comprise an (at least) axially movable lid opposing said further common wall, which enables individual tuning of the resonant frequency of said fourth resonator.

According to further exemplary embodiments, said further common wall comprises at least one opening, which enables RF signal coupling between the cavity of the third resonator and the cavity of the fourth resonator. According to further exemplary embodiments, said at least one opening of said further common wall comprises a circular (and/or circular ring) shape, preferably arranged coaxial with the longitudinal axis of at least one adjacent cavity.

According to further exemplary embodiments, a plurality of openings may be provided in said further common wall, wherein preferably said plurality of openings is arranged circumferentially around the longitudinal axis of said at least one adjacent cavity.

According to further exemplary embodiments, at least one of said plurality of openings may comprise a rectangular shape, preferably with rounded edges.

According to further exemplary embodiments, said at least one side wall of the third resonator and said at least one side wall of the fourth resonator are made of one piece forming a further common side wall for both the cavity of the third resonator and the cavity of the fourth resonator.

According to further exemplary embodiments, said further common wall and said further common side wall are made of one piece, which enables a mechanically stable and yet compact design.

According to further exemplary embodiments, said second resonator comprises a guiding device which is arranged at a first axial end section of said cavity of the second resonator and is configured to guide an axial movement of said common lid with respect to said cavity of the second resonator along a longitudinal axis of said cavity of the second resonator. This enables to tune the resonant frequency of the cavity of the second resonator by means of at least axially moving its lid.

According to further exemplary embodiments, said guiding device of said second resonator may have a configuration similar or identical to the guiding device of the first resonator. This way, by axially moving the lid of the first resonator, the resonant frequency of the cavity of the first resonator may be tuned, and by axially moving the common lid relative to the cavity of the second resonator, the resonant frequency of the cavity of the second resonator may be tuned.

According to further exemplary embodiments, said third resonator comprises a guiding device which is arranged at a first axial end section of said cavity of the third resonator and is configured to guide an axial movement of said common lid with respect to said cavity of the third resonator along a longitudinal axis of said cavity of the third resonator. This enables to tune the resonant frequency of the cavity of the third resonator by means of at least axially moving the common lid relative to the cavity of the third resonator.

According to further exemplary embodiments, said piece comprising said further common wall and said further common side wall may be moved, together with said common lid (i.e., there is no relative movement between said piece and said common lid), axially with respect to the second resonator, whereby the resonant frequency of the cavity of the second resonator may be tuned, whereas the resonant frequency of the cavity of the third resonator is not altered as the common lid is not moved axially with respect to said cavity of the third resonator while tuning said second resonator.

According to further exemplary embodiments, said piece comprising said further common wall and said further common side wall may be moved axially with respect to the common lid, whereby the resonant frequency of the cavity of the third resonator may be tuned, whereas the resonant frequency of the cavity of the second resonator, which is adjacent to said common lid, is not altered as the common lid is not required to be moved axially with respect to said cavity of the second resonator while tuning said third resonator.

According to further exemplary embodiments, said guiding device of the second resonator comprises a thread, preferably an inner (i.e., female) thread, wherein said common lid also comprises a thread, preferably an outer (i.e., male) thread that fits to said thread of said guiding device of the second resonator.

According to further exemplary embodiments, said guiding device of the third resonator comprises a thread, preferably an inner (i.e., female) thread, wherein said common lid also comprises a thread, preferably an outer (i.e., male) thread that fits to said thread of said guiding device of the third resonator.

According to further exemplary embodiments, at least one lid of said resonator comprises a circular cylindric shape, e.g. circular disc shape.

According to further exemplary embodiments, said common lid comprises a circular cylindric shape, e.g. circular disc shape. According to further exemplary embodiments, said common lid may comprise a radially outer section of said circular cylindric shape, where an outer (i.e., male) thread is provided which fits to the inner thread of said guiding device of the second resonator and/or the guiding device of the third resonator. According to further exemplary embodiments, said common lid is designed such that its outer thread can be screwed into both the inner thread of the guiding device of the second resonator and the inner thread of the guiding device of the third resonator at the same time.

According to further exemplary embodiments, an axial length (i.e., as seen parallel to a longitudinal axis of the apparatus and/or at least one of its resonator cavities) of said outer thread of the common lid is chosen such that a) it can be screwed into both the inner thread of the guiding device of the second resonator and the inner thread of the guiding device of the third resonator at the same time, thus mechanically coupling the second resonator and the third resonator with each other, and b) tuning of the second and/or third resonator is still possible, i.e. by screwing the common lid further into/out of the second and/or third resonator or the respective guiding devices of said resonators.

According to further exemplary embodiments, said common lid comprises at least one resonator post extending into at least one cavity adjacent to said common lid. According to further exemplary embodiments, said at least one resonator post of said common lid may be arranged on a first surface of said common lid facing the cavity of the second resonator, such that said at least one resonator post of the common lid extends into said cavity of the second resonator. According to further exemplary embodiments, said at least one resonator post of said common lid may be arranged on a second surface of said common lid facing the cavity of the third resonator, such that said at least one resonator post of the common lid extends into said cavity of the third resonator. According to further exemplary embodiments, at least one resonator post of said common lid may be arranged on said first surface of said common lid, and at least one (further) resonator post of said common lid may be arranged on said second surface.

According to further exemplary embodiments, said at least one resonator post of said common lid comprises a circular cylindrical shape. According to further exemplary embodiments, said at least one resonator post of said common lid comprises a hollow (circular) cylindrical shape. According to further exemplary embodiments, said at least one resonator post of said common lid is arranged coaxially with respect to a longitudinal axis of an adjacent cavity (i.e., of the second and/or third resonator) and/or with respect to an optional resonator post extending from another wall of said second and/or third resonator (i.e., the common wall and/or the further common wall and/or a first wall of the second resonator and/or a first wall of the third resonator) into the respective cavity.

According to further exemplary embodiments, at least one of said walls (e.g., first wall and/or side wall and/or common wall and/or further common wall and/or common side wall and/or further common side wall) and or said lids (lid of a resonator and/or common lid) of any of said resonators may comprise or be made of electrically conductive material such as copper, and/or may at least comprise an electrically conductive surface.

According to further exemplary embodiments, the principle of vertically (i.e., along a longitudinal axis) stacking of resonators may be extended to greater numbers of resonators, i.e. 5 or more.

Further exemplary embodiments relate to a filter for radio frequency, RF, signals comprising at least one resonator according to the embodiments and/or at least one apparatus according to the embodiments.

Further exemplary embodiments relate to a method of filtering a radio frequency, RF, signal, comprising passing said RF signal through a filter according to the embodiments.

According to further exemplary embodiments, said method further comprises tuning at least one resonator (e.g., its resonant frequency) of said filter by at least axially moving said lid (i.e., the lid of the resonator cavity and/or a common lid arranged between two cavities) with respect to said at least one cavity facing said (common) lid.

BRIEF DESCRIPTION OF THE FIGURES

Some exemplary embodiments will now be described with reference to the accompanying drawings.

DESCRIPTION OF THE EMBODIMENTS

Figure 1:
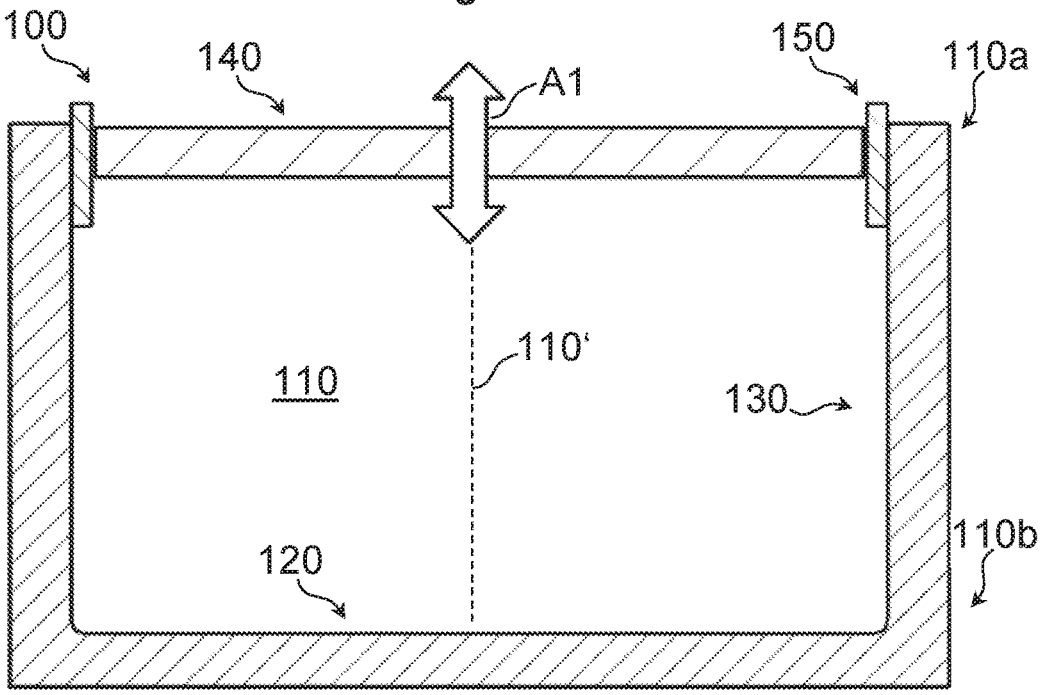
FIG. 1 schematically depicts a cross-sectional side view of a resonator according to exemplary embodiments, FIG. 2A, 2B each schematically depict a cross-sectional side view of a resonator according to further exemplary embodiments, FIG. 2C schematically depicts a tuning frequency characteristic according to further exemplary embodiments, FIG. 3, 4, 5A, 5B, 6A each schematically depict a cross-sectional side view of a resonator according to further exemplary embodiments, FIG. 6B schematically depicts a top view of a first wall of a resonator according to further exemplary embodiments, FIG. 7 schematically depicts a side view of an apparatus according to further exemplary embodiments, FIG. 8 schematically depicts a cross-sectional side view of an apparatus according to further exemplary embodiments, FIG. 9A, 9B each schematically depict a top view of a filter according to further exemplary embodiments, FIG. 10 schematically depicts a cross-sectional side view of an apparatus according to further exemplary embodiments, FIG. 11 schematically depicts a cross-sectional side view of an apparatus according to further exemplary embodiments, FIG. 12A schematically depicts a perspective view of a filter according to further exemplary embodiments, FIG. 12B schematically depicts a cross-sectional side view of the filter of FIG. 12A, FIG. 12C schematically depicts operational parameters of a filter according to further exemplary embodiments, and FIG. 13 schematically depicts a simplified flow-chart of a method according to further exemplary embodiments.

FIG. 1 schematically depicts a resonator 100 for radio frequency, RF, signals according to exemplary embodiments in a cross-sectional side view.

The resonator 100 comprises a cavity 110 having a longitudinal axis 110', a first wall 120, at least one side wall 130, and a lid 140 arranged opposite the first wall 120, wherein said resonator 100 further comprises a guiding device 150 which is arranged at said at least one side wall 130 and is configured to guide an axial movement A1 of said lid 140 along said longitudinal axis 110'. This enables an efficient tuning of the resonator 100, particularly of a resonant frequency of said resonator 100. Thus, no further, separate tuning elements as known from conventional systems are required for tuning said resonator 100.

According to further exemplary embodiments, said first wall 120 may be a bottom wall of the resonator 100, and/or said lid 140 may be a top wall of the resonator 100. Presently, the guiding means 150 is arranged in a first axial end section 110*a* of the cavity 110, and the first wall 120 is arranged in a second axial end section 110*b* of the cavity 110.

According to further exemplary embodiments, said cavity 110 may comprise a rectangular cross-section (in this case, e.g. four side walls pairwise parallel to each other may be provided). According to further exemplary embodiments, said cavity 110 may comprise a circular cross-section (in this case, e.g. said (single) side wall 130 may be provided, which may e.g. comprise a basically hollow circular cylindrical shape).

Figure 2A:
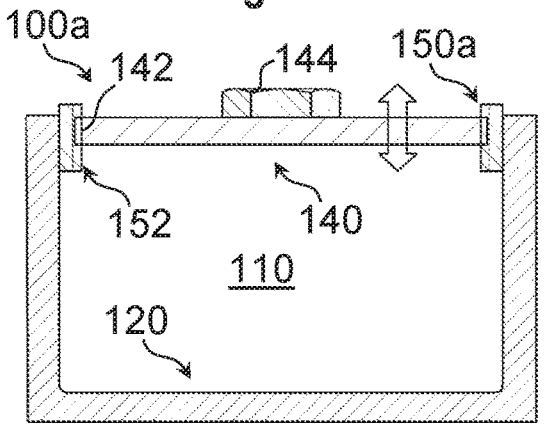

According to further exemplary embodiments, cf. the resonator 100*a* of FIG. 2A, said guiding device 150*a* comprises a first thread 152, preferably an internal (i.e., female) thread 152, and said lid 140 comprises a second thread 142, preferably an external (i.e., male) thread that fits to said first thread 152 of said guiding device 150*a*. Thus, a precise tuning of the resonator's resonant frequency is enabled by rotating said lid 140 within the guiding device 150*a*. In these embodiments, the guiding device 150*a* is configured to guide both a rotational movement (screwing motion) and said axial movement of the lid 140 with respect to the resonator's cavity 110.

According to further embodiments, said lid 140 comprises a profile 144, e.g. screw profile, for example a hexagonal profile similar to a hex nut, which facilitates driving a rotational movement of said lid 140, e.g. for tuning the resonator cavity 110 associated with said lid 140. According to further embodiments, said profile 144 is provided on a surface of said lid 144, preferably an outer surface of said lid, to enable easy access from the outside of the resonator 100*a*.

According to further embodiments, said guiding device 150*a* of the resonator 100*a* of FIG. 2A may also comprise a first thread which is an external thread (not shown), and said lid 140 may comprise a second thread 142 which is an internal thread that fits to said first thread of said guiding device. Thus, a precise tuning of the resonator's resonant frequency is enabled by rotating said lid 140 around the guiding device. In these embodiments, too, the guiding device is configured to guide both a rotational movement (screwing motion) and said axial movement of the lid 140 with respect to the resonator's cavity 110.

Figure 2B:
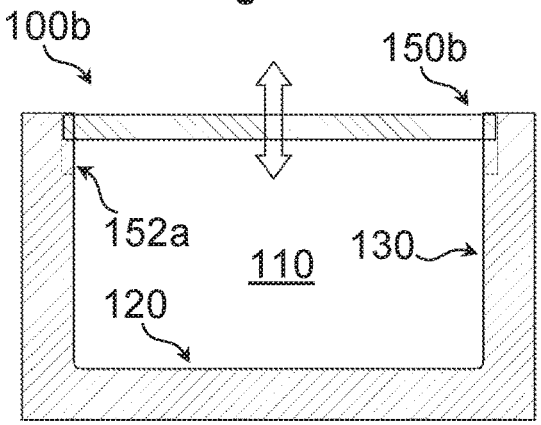

FIG. 2B depicts a resonator 100*b* according to further exemplary embodiments, wherein the guiding means 150*b* having an inner thread 152*a* are integrated into the side wall 130.

Figure 2C:
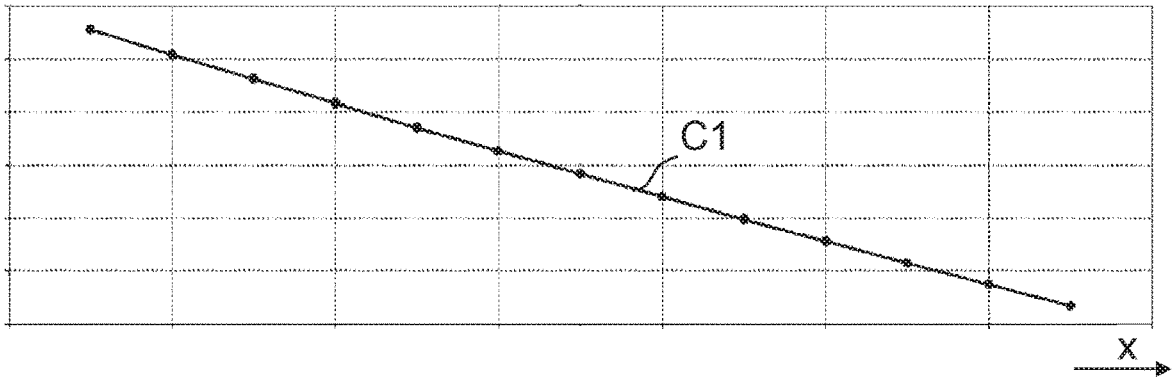

FIG. 2C schematically depicts a tuning frequency characteristic of a resonator according to further exemplary embodiments. Curve C1 depicts a resonant frequency over a first spatial coordinate x, which e.g. characterizes an axial position of the lid 140 (FIG. 1) along the longitudinal axis 110' of the cavity 110. As can be seen from FIG. 2C, the resonant frequency C1 changes linearly over the lid position x.

Figure 3:
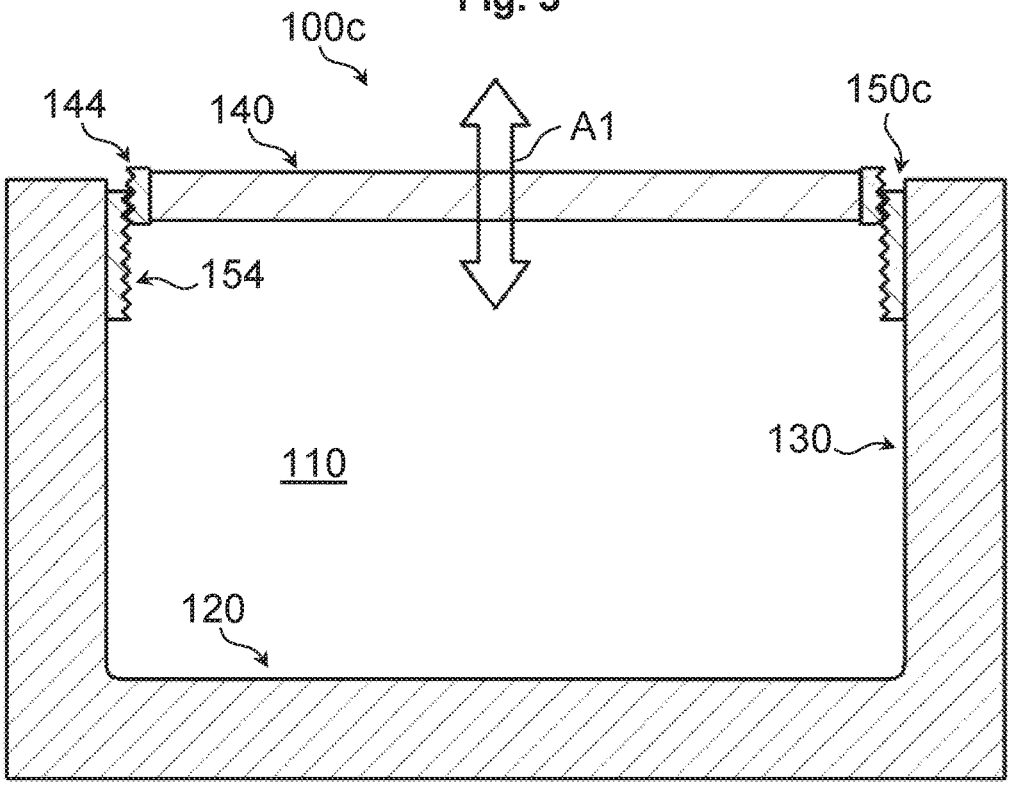

According to further exemplary embodiments, cf. the resonator 100*c* of FIG. 3, said guiding device 150*c* comprises a first serrated surface 154 (e.g., in the form of a "step slide"), and said lid 140 comprises a second serrated surface 144 that fits to said first serrated surface 154 of said guiding device 150*c*. This enables a stepwise axial movement A1 of said lid 140 relative to said cavity 110, i.e. without rotation of said lid, i.e. tuning by means of setting different discrete axial positions for the lid 140 of resonator 100*c* of FIG. 3, in contrast to the continuous movement that may be attained by the screwing motion of the lid 140 of the resonator 100*a* of FIG. 2A. A step size of said stepwise axial movement may be controlled by providing the serrated surfaces 144, 154 with a corresponding geometry.

According to further exemplary embodiments, guiding means 150*c* comprising said serrated surfaces 154 may be used with rectangular and/or circular cross-sections of said cavity 110, while according to other exemplary embodiments guiding means 150*a* (FIG. 2A) comprising threads are preferably used with a circular cross-section of said cavity 110.

Figure 4:
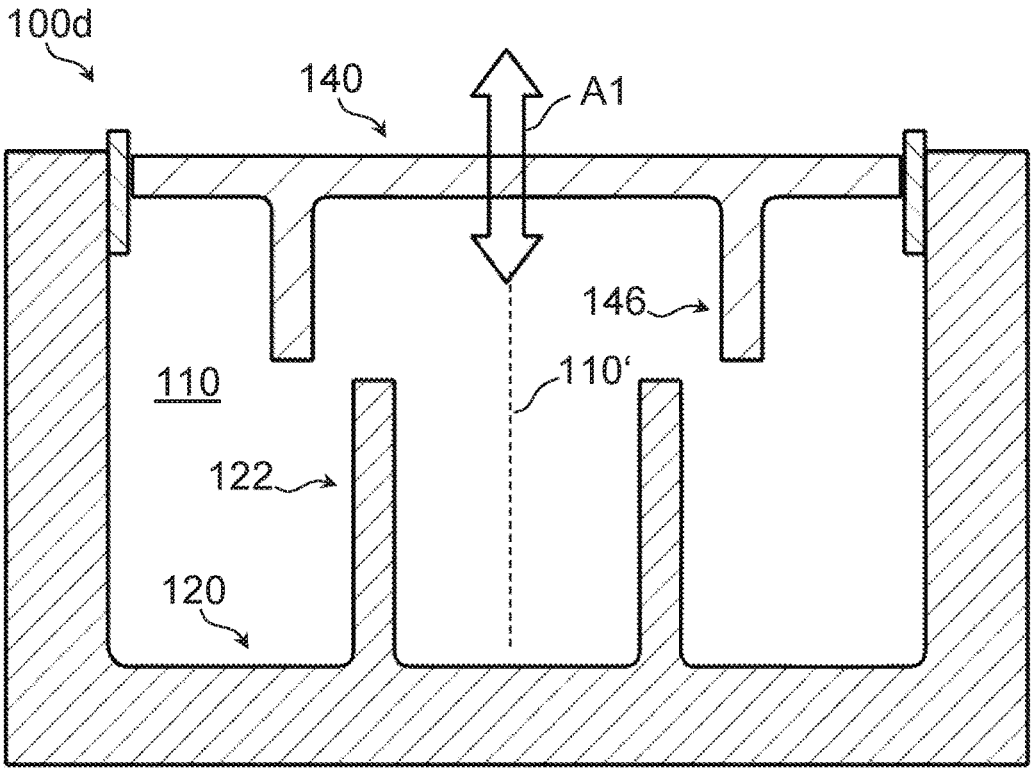

According to further exemplary embodiments, cf. the resonator 100*d* of FIG. 4, said first wall 120 comprises at least one resonator post 122 extending into said cavity 110 (preferably perpendicular to an inner surface of said first wall, i.e. parallel to the longitudinal axis 110'). According to further exemplary embodiments, said at least one resonator post 122 comprises a circular cylindrical shape. According to further exemplary embodiments, said at least one resonator post 122 comprises a hollow (circular) cylindrical shape, as exemplarily depicted by FIG. 4. According to further exemplary embodiments, said at least one resonator post 122 is arranged coaxially with respect to the longitudinal axis 110' of the cavity 110.

According to further exemplary embodiments, said lid 140 comprises at least one resonator post 146 extending into said cavity 110, preferably perpendicular to an inner surface of said lid 140. According to further exemplary embodiments, said at least one resonator post 146 of said lid 140 comprises a circular cylindrical shape. According to further exemplary embodiments, said at least one resonator post 146 comprises a hollow (circular) cylindrical shape, as exemplarily depicted by FIG. 4. According to further exemplary embodiments, said at least one resonator post 146 is arranged coaxially with respect to the longitudinal axis 110' of the cavity 110 and/or an optional resonator post 122 extending from said first wall 120 into said cavity 110.

Figure 5A:
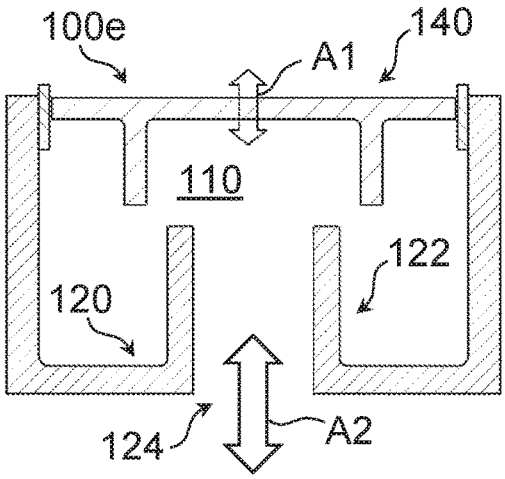
Figure 5B:
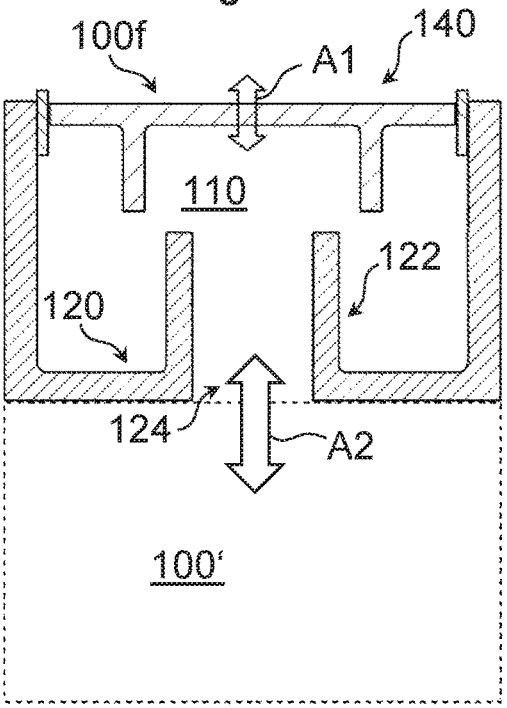

According to further exemplary embodiments, cf. the resonator 100*e* of FIG. 5A, said first wall 120 comprises at least one opening 124, which enables to exchange RF signals A2 and/or generally electromagnetic energy A2 with an adjacent volume such as an optional neighboring further resonator, cf. the dashed rectangle 100' of the configuration of FIG. 5B. This enables to provide a particularly small configuration of several resonators 100*f*, 100', as depicted by FIG. 5B, which may be coupled via said at least one opening 124. This arrangement of resonators 100*f*, 100' may also be referred to as "stacked configuration", because the first resonator 100*f* and the second resonator 100' of FIG. 5B are arranged together along the longitudinal axes of their cavities.

According to further exemplary embodiments, said at least one opening 124 of said first wall 120, comprises a circular (and/or circular ring) shape, preferably arranged coaxial with the longitudinal axis of the cavity 110 of said resonator 100*f*.

Figure 6A:
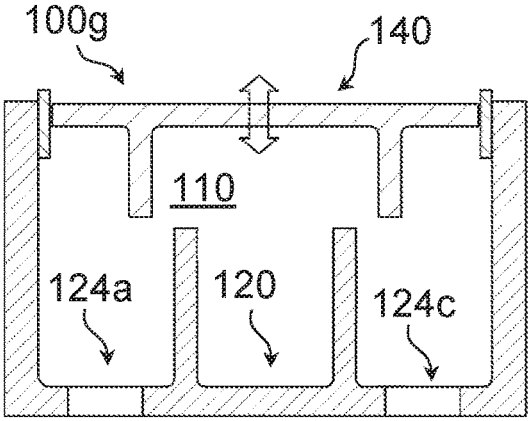
Figure 6B:
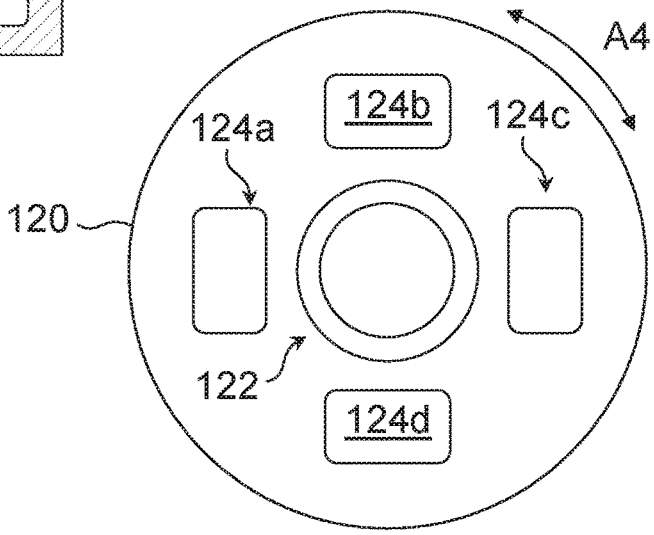

According to further exemplary embodiments, cf. the resonator 100*g* of FIG. 6A, a plurality of openings 124*a*, 124*c* may be provided in said first wall 120, wherein preferably said plurality of openings is arranged circumferentially around said longitudinal axis 110' (FIG. 1) of the cavity 110. According to further exemplary embodiments, at least one of said plurality of openings 124*a*, 124*c* may comprise a rectangular shape, preferably with rounded edges, cf. the top view of an exemplary configuration of the first wall 120 of FIG. 6B. As can be seen, the first wall 120 presently comprises four rectangular openings 124*a*, 124*b*, 124*c*, 124*d* arranged circumferentially around the longitudinal axis (perpendicular to the drawing plane of FIG. 6B), wherein said rectangular openings 124*a*, 124*b*, 124*c*, 124*d* have rounded edges. Double arrow A4 indicates a rotational movement of the first wall 120 (e.g., in combination with the side wall(s) 130 (FIG. 1)) which may be applied according to further exemplary embodiments, e.g. to attain a relative rotational movement between the walls 120, 130 and the lid 140.

Figure 7:
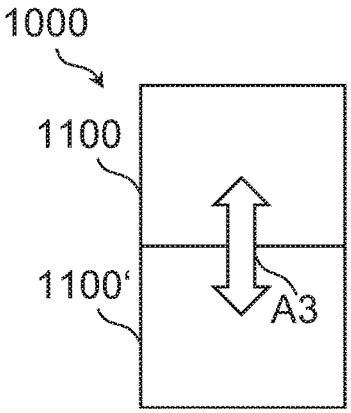

Further exemplary embodiments, cf. FIG. 7, relate to an apparatus 1000 comprising a first resonator 1100 according to the embodiments and at least one further resonator 1100' for radio frequency, RF, signals, which is preferably coupled (cf. block arrow A3) with said first resonator 1100. This way, a compact and mechanically stable configuration having two resonators may be provided, wherein at least the first resonator 1100 is efficiently tunable regarding its resonant frequency by means of at least axially moving its lid 140 (FIG. 1).

According to further exemplary embodiments, more than two resonators 1100, 1100' may also be arranged together, preferably along their axial direction, e.g. in a stacked configuration, wherein at least two resonators of said configuration may be coupled with each other. However, according to further exemplary embodiments, two or more resonators 1100, 1100' may also be arranged together, preferably along their axial direction, e.g. in a stacked configuration, wherein no coupling between adjacent (or non-adjacent or between any) resonators of such stack may be provided.

According to further exemplary embodiments, said at least one further resonator 1100' of said apparatus 1000 (FIG. 7) may be a resonator according to the embodiments, e.g. having the configuration of any of the exemplarily depicted resonators 100*a* to 100*g* (or any combination thereof) as explained above with reference to FIG. 1 to FIG. 6B. This way, a compact and mechanically stable configuration having two resonators 1100, 1100' may be provided, wherein at least the first resonator 1100 and the further resonator 1100' are efficiently tunable regarding their resonant frequency by means of at least axially moving the respective lid.

According to further exemplary embodiments, said at least one further resonator 1100' may be a conventional resonator. According to further exemplary embodiments, said first resonator and said at least one further resonator (or their respective cavities) are not coupled with each other.

Figure 8:
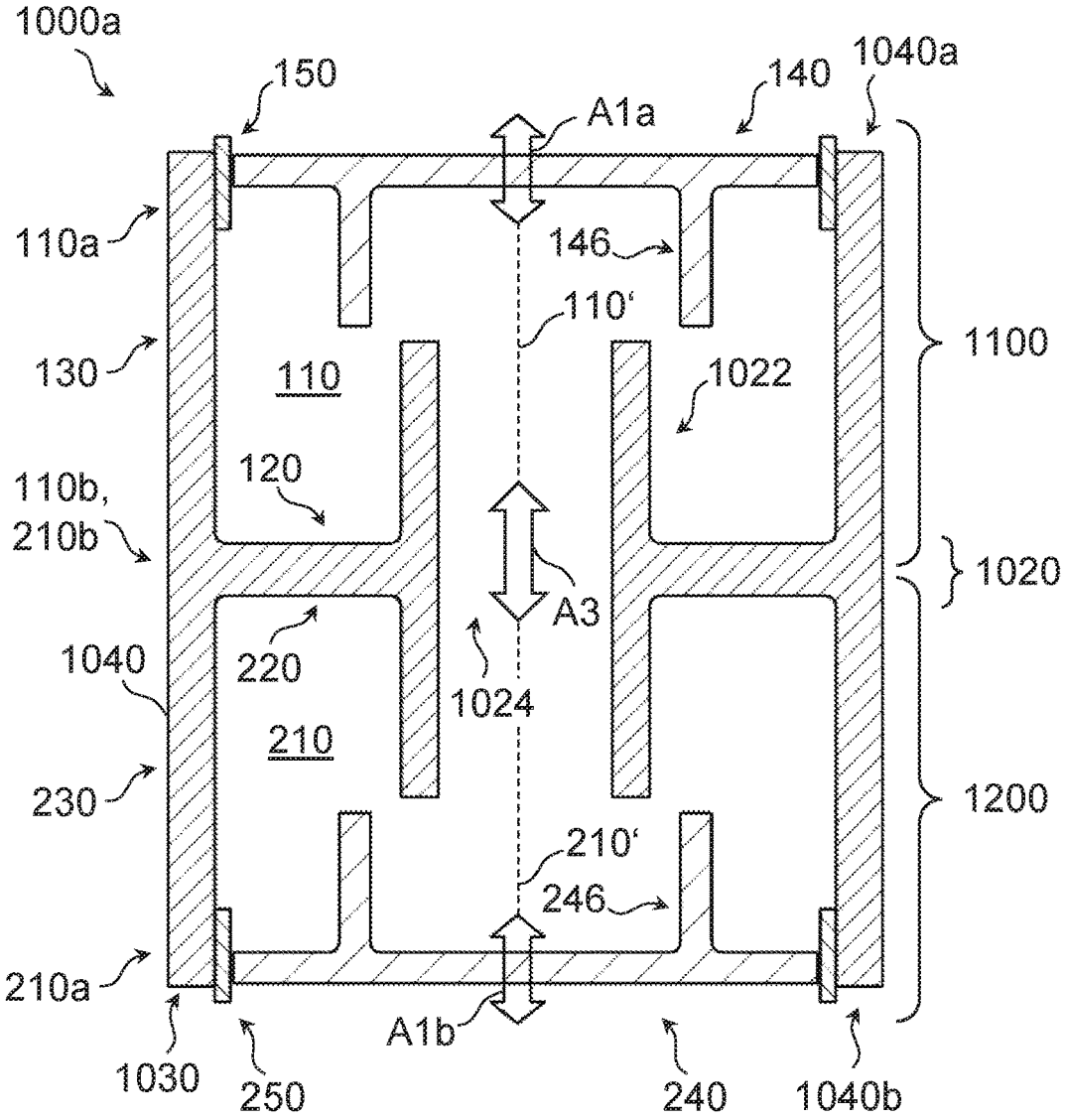

According to further exemplary embodiments, cf. the apparatus 1000*a* of FIG. 8, said at least one further resonator is a second resonator 1200, wherein said second resonator 1200 comprises a configuration according to the embodiments. As can be seen from FIG. 8, the first resonator 1100 of the apparatus 1000*a* basically comprises a configuration similar to the resonators 100*e*, 100*f* of FIG. 5A, 5B. According to further exemplary embodiments, said second resonator 1200 comprises a cavity 210 having a longitudinal axis 210', a first wall 220, at least one side wall 230, and a lid 240 arranged opposite the first wall 220, wherein said second resonator 1200 further comprises a guiding device 250 which is arranged at said at least one side wall 230 and is configured to guide an axial movement of said lid 240 along said longitudinal axis 210' (preferably at least an axial movement, in case of e.g. serrated surfaces, and both a rotational and axial movement in case of a thread connection between guiding device 250 and the lid 240).

According to further exemplary embodiments, the first wall 120 of the first resonator 1100 and the first wall 220 of the second resonator 1200 are adjacent to each other forming a common wall 1020 of the apparatus 1000*a* which at least partly (e.g., apart from one or more optional openings 1024 for RF signal coupling A3) separates the cavity 110 of the first resonator 1100 and the cavity 210 of the second resonator 1200 from each other, wherein preferably said common wall 1020 comprises at least one opening 1024. This enables a particularly small configuration of the apparatus 1000*a*, which may also be referred to as "stacked configuration", because the first resonator 1100 and the second resonator 1200 may be arranged together along the longitudinal axes 110',210' of their cavities. According to further exemplary embodiments, the first resonator 1100 and the second resonator 1200 are arranged relative to each other such that the longitudinal axes 110',210' of their respective cavities 110, 210 are collinear.

According to further exemplary embodiments, said at least one opening 1024 of said common wall 1020 comprises a circular (and/or circular ring) shape, preferably arranged coaxial with the longitudinal axis 110',210' of at least one adjacent cavity 110, 210. According to further exemplary embodiments, a plurality of openings (not depicted in FIG. 8) may be provided in said common wall, wherein preferably said plurality of openings is arranged circumferentially around the longitudinal axis of said at least one adjacent cavity. According to further exemplary embodiments, at least one of said plurality of openings may comprise a rectangular shape, preferably with rounded edges.

According to further exemplary embodiments, the cavity 110 of the first resonator 1100 may have a first geometry, e.g. particular cross-section (shape and/or size), and the cavity 210 of the second resonator 1200 may have a second geometry, e.g. particular cross-section, wherein said second geometry is different from said first geometry.

According to further exemplary embodiments, the second geometry may be similar or identical to the first geometry.

According to further exemplary embodiments, said at least one side wall 130 of the first resonator 1100 and said at least one side wall 230 of the second resonator 1200 are made of one piece forming a common side wall 1030 for both said first cavity 110 and said second cavity 210, which yields a particularly compact configuration with high mechanical stability.

According to further exemplary embodiments, said common wall 1020 and said common side wall 1030 are made of one piece 1040.

According to further exemplary embodiments, in a first axial end section 1040*a* of said piece 1040 (corresponding with a first axial end section 110*a* of the first resonator 1100), a first guiding device 150 is provided enabling at least axial movement Ala of the lid 140 of the first resonator 1100 and thus individual tuning of the resonant frequency of the first resonator 1100.

Similarly, according to further exemplary embodiments, in a second axial end section 1040*b* of said piece 1040 (corresponding with a first axial end section 210*a* of the second resonator 1200), a second guiding device 250 is provided enabling at least axial movement A1*b* of the lid 250 of the second resonator 1200 and thus individual tuning of the resonant frequency of the second resonator 1200. This way, the resonant frequencies of both resonators 1100, 1200 can efficiently be tuned from outside the apparatus 1000*a* (and independently from each other) by moving at least one of the lids 140, 240, while the cavities 110, 210 are at least partly separated from each other by means of the common wall 1020 arranged in respective second axial end sections 110*b*, 210*b* of the cavities 110, 210.

According to further exemplary embodiments, the common wall 1020 comprises resonator posts 1022 extending into both adjacent cavities 110, 210, wherein said resonator posts 1022 presently comprise hollow circular cylindrical shape, similar to the resonator posts 122 of FIG. 5A, 5B. According to further exemplary embodiments, the opening 1024 is arranged radially inside said resonator posts 1022. In other words, presently, the opening 1024 in the common wall 1020 corresponds with an interior of the hollow circular cylindrical shape of the resonator posts 1022.

According to further exemplary embodiments, at least one of the lids 140, 240 may also comprise at least one resonator post 146, 246, e.g. similar to the embodiments exemplarily depicted by FIG. 4, 5A, 5B.

Figure 9A:
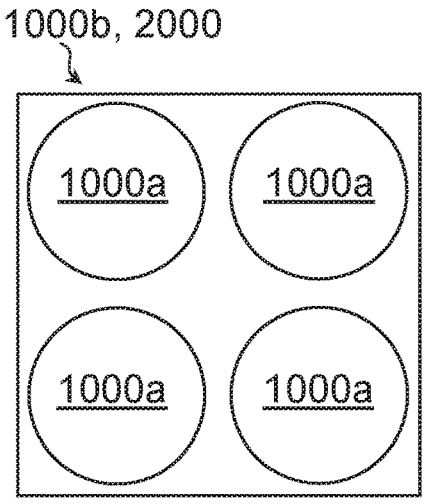
Figure 9B:
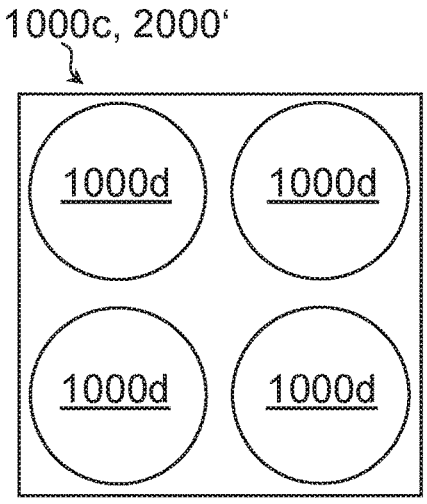

FIG. 9A, 9B each schematically depict a top view of a filter for RF signals according to further exemplary embodiments. The filter 2000 of FIG. 9A comprises an apparatus 1000*b* having four apparatus 1000*a* according to FIG. 8. In other words, the filter 2000 of FIG. 9A comprises eight resonators, wherein two resonators each are stacked together in accordance with the FIG. 8 embodiment 1000*a*. This way, a compact and yet efficiently tunable RF filter 2000, e.g. an eight-pole filter, may be provided, which may e.g. be integrated into an antenna system (not shown) for transmitting and/or receiving electromagnetic waves, e.g. RF signals.

Figure 10:
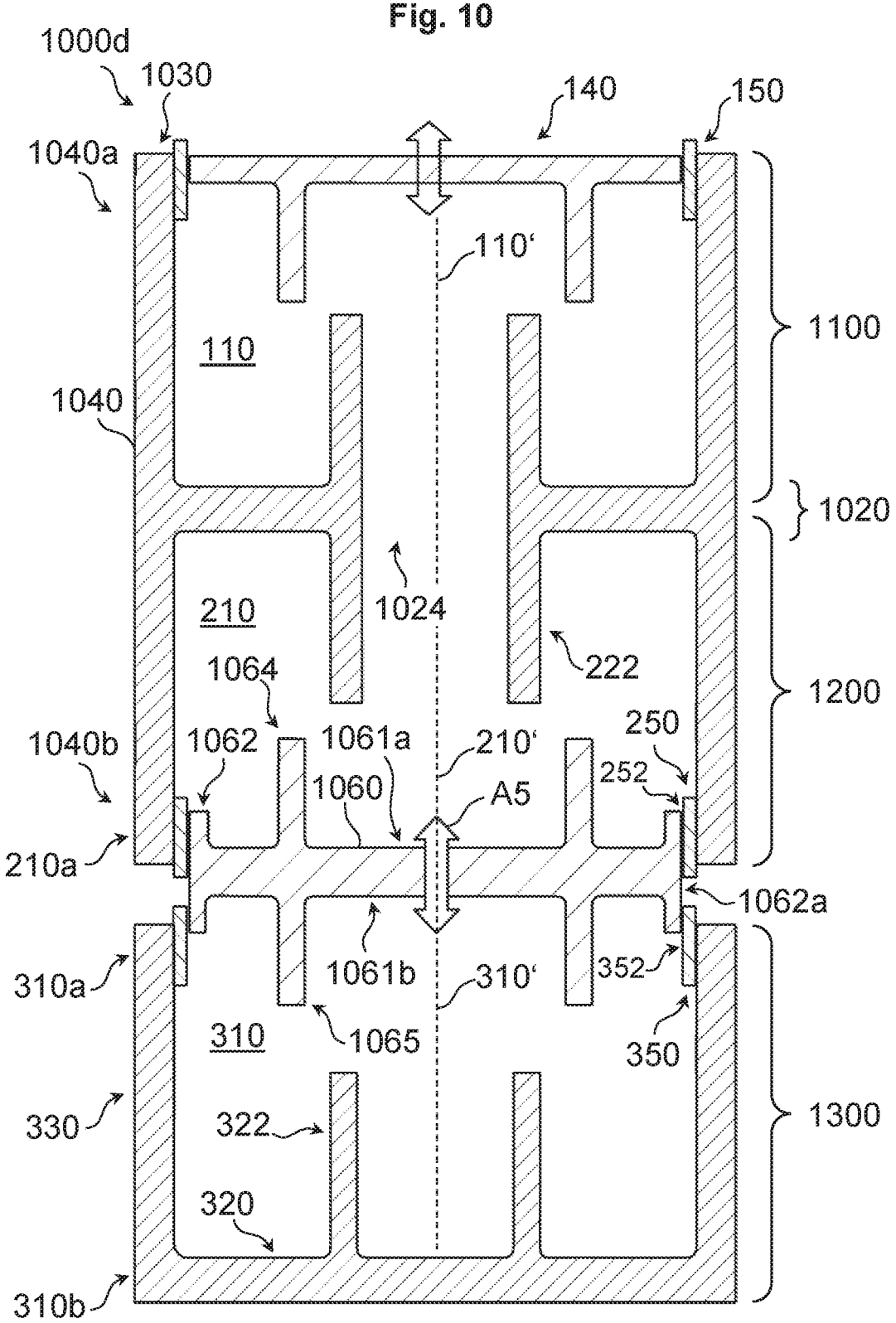

In contrast, the further RF filter 2000' of FIG. 9B comprises an apparatus 1000*c* having four apparatus 1000*d*, which will be explained below with reference to FIG. 10, wherein each apparatus 1000*d* comprises three resonators. In other words, the filter 2000' of FIG. 9B comprises twelve resonators, wherein three resonators each are stacked together in accordance with the FIG. 10 embodiment 1000*d*.

In the following, further exemplary embodiments are explained with reference to the apparatus 1000*d* of FIG. 10. The apparatus 1000*d* comprises a first resonator 1100 and a second resonator 1200 with a common wall 1020 and common side wall 1030 forming one piece 1040, as well as said guiding means 150, 250. Additionally, according to further exemplary embodiments, a third resonator 1300 with a cavity 310 is provided, wherein said third resonator 1300 comprises at least one side wall 330 and is arranged such that a first axial end section 310*a* of its cavity 310 faces the first axial end section 210*a* of the cavity 210 of the second resonator 1200. Further, instead of the lid 240 of FIG. 8, a common lid 1060 is provided between the second resonator 1200 and the third resonator 1300 (i.e., in a second axial end section 1040*b* of said one piece 1040), said common lid 1060 at least partly (e.g., in the case of RF coupling openings, not shown in FIG. 10), preferably fully, covering the cavity 210 of the second resonator 1200 and the cavity 310 of the third resonator 1300. This way, a compact and mechanically stable configuration 1000*d* having three resonators 1100, 1200, 1300 may be provided, wherein at least the first resonator 1100 is efficiently tunable regarding its resonant frequency by means of at least axially moving its lid 140.

According to further exemplary embodiments, said third resonator 1300 comprises a first wall 320 in a second axial end section 310*b* of the cavity 310, which may optionally comprise at least one resonator post 322 extending into the cavity 310, e.g. similar to resonator post 122 of FIG. 4.

According to further exemplary embodiments, said second resonator 1200 comprises a guiding device 250 which is arranged at a first axial end section 210*a* of said cavity 210 of the second resonator 1200 and is configured to guide an axial movement A5 of said common lid 1060 with respect to said cavity 210 of the second resonator 1200 along a longitudinal axis 210' of said cavity 210 of the second resonator 1200. This enables to tune the resonant frequency of the cavity 210 of the second resonator 1200 by means of at least axially moving the common lid 1060.

According to further exemplary embodiments, said guiding device 250 of said second resonator 1200 may have a configuration similar or identical to the guiding device 150 of the first resonator 1100. This way, by axially moving the lid 140 of the first resonator 1100, the resonant frequency of the cavity 110 of the first resonator 1100 may be tuned, and by axially moving the common lid 1060 relative to the cavity 210 of the second resonator 1200, the resonant frequency of the cavity 210 of the second resonator 1200 may be tuned.

According to further exemplary embodiments, different resonators of an apparatus 1000*d*, however, may comprise different types of guiding devices. As an example, a first guiding device associated with a first cavity may comprise a thread mechanism 150*a* (FIG. 2A), while a second guiding device associated with at least one further, e.g. second, cavity may comprise a step slide mechanism 150*b* (FIG. 2B).

According to further exemplary embodiments, said third resonator 1300 (FIG. 10) comprises a guiding device 350 which is arranged at a first axial end section 310*a* of said cavity 310 of the third resonator 1300 and is configured to guide an axial movement A5 of said common lid 1060 with respect to said cavity 310 of the third resonator 1300 along a longitudinal axis 310' of said cavity 310 of the third resonator 1300. This enables to tune the resonant frequency of the cavity 310 of the third resonator 1300 by means of at least axially moving the common lid 1060 relative to the cavity 310 of the third resonator 1300.

According to further exemplary embodiments, said piece 1040 comprising said common wall 1020 and said common side wall 1030 may be moved, together with said common lid 1060 (i.e., there is no relative movement between said piece 1040 and said common lid 1060), (at least) axially with respect to the third resonator 1300, whereby the resonant frequency of the cavity 310 of the third resonator 1300 may be tuned, whereas the resonant frequency of the cavity 210 of the second resonator 1200 is not altered as the common lid 1060 is not moved axially with respect to said cavity 210 of the second resonator 1200 while tuning said third resonator 1300.

According to further exemplary embodiments, said piece 1040 comprising said common wall 1020 and said common side wall 1030 may be moved axially with respect to the common lid 1060, whereby the resonant frequency of the cavity 210 of the second resonator 1200 of the apparatus 1000*d* may be tuned, whereas the resonant frequency of the cavity 310 of the third resonator 1300, which is adjacent to said common lid 1060, is not altered as the common lid 1060 is not required to be moved axially with respect to said cavity 310 of the third resonator 1300 while tuning said second resonator 1200.

According to further exemplary embodiments, said guiding device 250 of the second resonator 1200 comprises a thread 252, preferably an inner (i.e., female) thread 252, wherein said common lid 1060 also comprises a thread, preferably an outer (i.e., male) thread 1062*a* arranged at a radially outer section 1062 of the common lid 1060, wherein said male thread 1062*a* of the common lid 1060 fits to said thread 252 of said guiding device 250 of the second resonator 1200.

According to further exemplary embodiments, said guiding device 350 of the third resonator 1300 comprises a thread 352, preferably an inner (i.e., female) thread 352, wherein said common lid 1060 comprises said male thread 1062*a* that also fits to said thread 352 of said guiding device 350 of the third resonator 130. This way, axial (and rotational) movement of the common lid 1060 with respect to both adjacent resonators 1200, 1300 may be effected.

According to further exemplary embodiments, at least one lid 140, 1060 of said apparatus 1000*d* comprises a circular cylindric shape, e.g. circular disc shape.

According to further exemplary embodiments, said common lid 1060 (FIG. 10) comprises a circular cylindric shape, e.g. circular disc shape. According to further exemplary embodiments, said common lid 1060 may comprise said radially outer section 1062, where said outer (i.e., male) thread 1062*a* is provided which fits to the inner thread 252 of said guiding device 250 of the second resonator 1200 and/or the guiding device 350 of the third resonator 1300. According to further exemplary embodiments, said common lid 1060 is designed such that its outer thread 1062 can be screwed into both the inner thread 252 of the guiding device 250 of the second resonator 1200 and the inner thread 352 of the guiding device 350 of the third resonator 1300 at the same time.

According to further exemplary embodiments, an axial length (i.e., as seen parallel to a longitudinal axis 210',310' of the apparatus 1000*d* and/or at least one of its resonator cavities 210, 310) of said outer thread 1062*a* of the common lid 1060 is chosen such that a) it can be screwed into both the inner thread 252 of the guiding device 250 of the second resonator 1200 and the inner thread 352 of the guiding device 350 of the third resonator 1300 at the same time, thus mechanically coupling the second resonator 1200 and the third resonator 1300 with each other, and b) tuning of the second and/or third resonator is still possible, i.e. by screwing the common lid 1060 further into/out of the second and/or third resonator or the respective guiding devices 250, 350 of said resonators 1200, 1300.

According to further exemplary embodiments, said common lid 1060 comprises at least one resonator post 1064, 1064 extending into at least one cavity 210, 310 adjacent to said common lid 1060. According to further exemplary embodiments, said at least one resonator post 1064 of said common lid 1060 may be arranged on a first surface 1061*a* of said common lid 1060 facing the cavity 210 of the second resonator 1200, such that said at least one resonator post 1064 of the common lid 1060 extends into said cavity 210 of the second resonator 1200. According to further exemplary embodiments, at least one resonator post 1065 of said common lid 1060 may be arranged on a second surface 1061*b* of said common lid 1060 facing the cavity 310 of the third resonator 1300, such that said resonator post 1065 of the common lid 1060 extends into said cavity 310 of the third resonator 1300. According to further exemplary embodiments, at least one resonator post 1064, 1065 of said common lid 1060 may be arranged on said first surface 1061*a* of said common lid 1060, and at least one (further) resonator post 1065 of said common lid 1060 may be arranged on said second surface 1061*b*.

According to further exemplary embodiments, said at least one resonator post 1064, 1065 of said common lid 1060 comprises a circular cylindrical shape. According to further exemplary embodiments, said at least one resonator post 1064, 1065 of said common lid 1060 comprises a hollow (circular) cylindrical shape, cf. FIG. 10. According to further exemplary embodiments, said at least one resonator post 1064, 1065 of said common lid 1060 is arranged coaxially with respect to a longitudinal axis 210',310' of an adjacent cavity 210, 310 (i.e., of the second and/or third resonator 1200, 1300) and/or with respect to an optional resonator post 222, 322 extending from another wall 1020, 320 of said second and/or third resonator 1200, 1300 (i.e., the common wall 1020 and/or the first wall 320 of the third resonator 1300) into the respective cavity.

According to further embodiments, at least one of the guiding devices 150, 250, 350 may also comprise an outer thread (not shown), and the (common) lid 140, 1060 may comprise a corresponding inner thread (or two inner threads) (not shown) that fit(s) to said outer thread(s). As an example, according to further embodiments, the guiding devices 250, 350 may comprise outer threads (not shown), and the radially outer section 1062 of the common lid 1060 may comprise inner threads (not shown) to cooperate with one of said outer threads of the guiding devices 250, 350 each.

Figure 11:
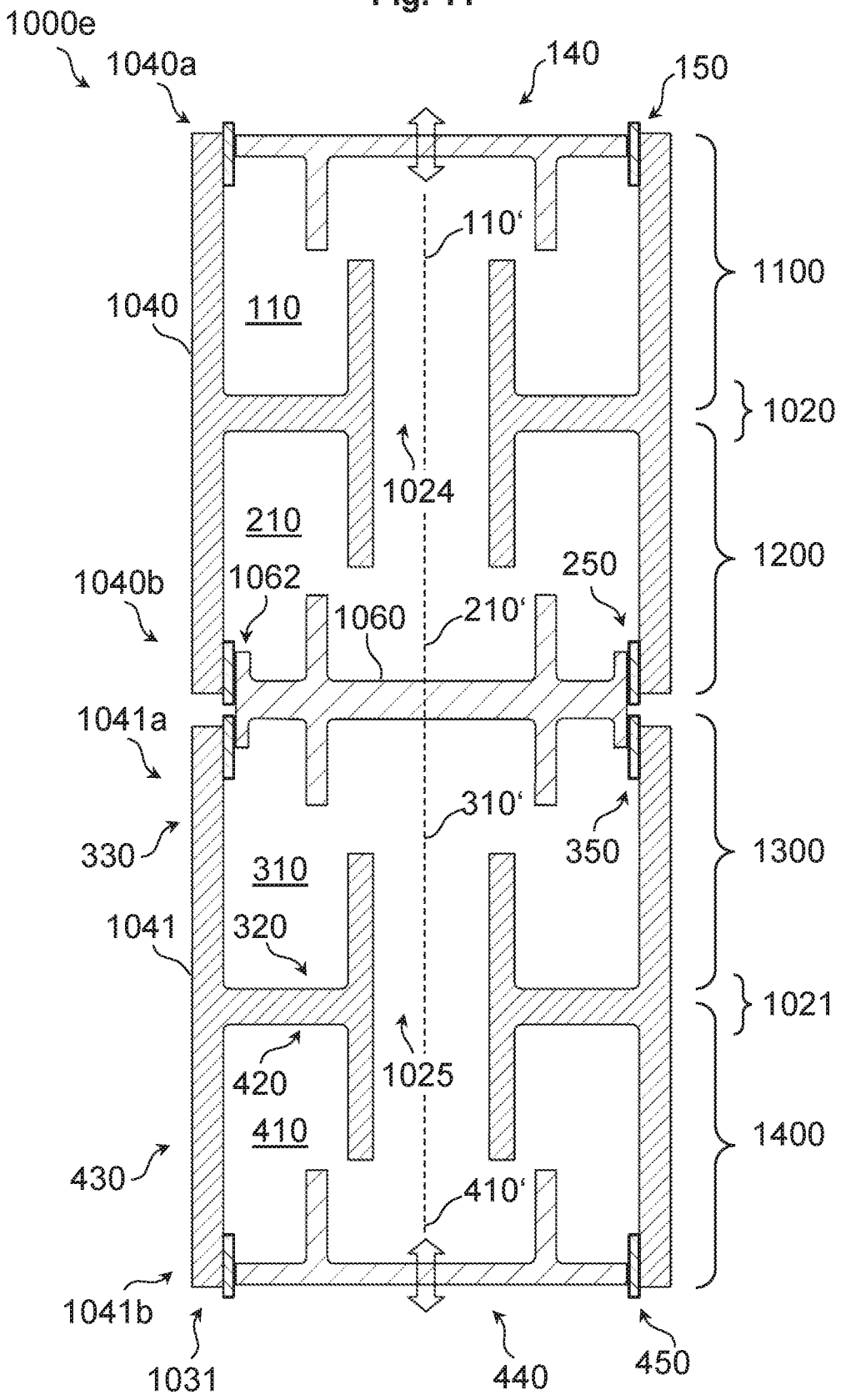

According to further exemplary embodiments, cf. the apparatus 1000*e* of FIG. 11, a fourth resonator 1400 is provided in addition to the resonators 1100, 1200, 1300. The first resonator 1100 and the second resonator 1200 of the apparatus 1000*e* of FIG. 11, and the arrangement of the common lid 1060 of FIG. 11 are similar to the corresponding elements 1100, 1200, 1060 of the apparatus 1000*d* of FIG. 10.

Further, as can be seen from FIG. 11, said fourth resonator 1400 comprises a cavity 410, a first wall 420, and at least one side wall 430, wherein a first wall 320 of the third resonator 1300 and the first wall 420 of the fourth resonator 1400 are adjacent to each other forming a further common wall 1021 (similar to common wall 1020 between the first and second resonator 1100, 1200), which at least partly (e.g., apart from one or more optional openings 1025 for RF signal coupling) separates the cavity 310 of the third resonator 1300 and the cavity 410 of the fourth resonator 1400 from each other. This way, a compact and mechanically stable configuration 1000*e* having four resonators 1100, 1200, 1300, 1400 may be provided.

According to further exemplary embodiments, the shape of said fourth resonator 1400 is similar or identical to the shape of the first and/or second resonator 1200. As an example, the fourth resonator 1400 may also comprise an (at least) axially movable lid 440 opposing said further common wall 1021, which enables individual tuning of the resonant frequency of said fourth resonator.

According to further exemplary embodiments, said further common wall 1021 comprises at least one opening 1025, which enables RF signal coupling between the cavity 310 of the third resonator 1300 and the cavity 410 of the fourth resonator 1400. According to further exemplary embodiments, said at least one opening 1025 of said further common wall 1021 comprises a circular (and/or circular ring) shape, preferably arranged coaxial with the longitudinal axis 310',410' of at least one adjacent cavity.

According to further exemplary embodiments, a plurality of openings (not shown) may be provided in said further common wall 1021, wherein preferably said plurality of openings is arranged circumferentially around the longitudinal axis of said at least one adjacent cavity. According to further exemplary embodiments, at least one of said plurality of openings may comprise a rectangular shape, preferably with rounded edges.

According to further exemplary embodiments, said at least one side wall 330 of the third resonator 1300 and said at least one side wall 430 of the fourth resonator 1400 are made of one piece forming a further common side wall 1031 for both the cavity 310 of the third resonator 1300 and the cavity 410 of the fourth resonator 1400.

According to further exemplary embodiments, said further common wall 1021 and said further common side wall 1031 are made of one piece 1041, which enables a mechanically stable and yet compact design.

According to further exemplary embodiments, said one piece 1041 is similar to said one piece 1040 comprising the first and second resonators 1100, 1200, so that common parts 1040, 1041 may be provided to form the pairs 1100, 1200 and 1300, 1400 of resonators.

Tuning of any of the resonators 1100, 1200, 1300 of the apparatus 1000*e* of FIG. 11 may be effected as explained above with reference to FIG. 10. Tuning of the fourth resonator 1400 of FIG. 11 may be effected by at least axially moving its lid 440 relative to the cavity 410 or the piece 1041, which is enabled by providing a respective guiding device 450 in a second axial end section 1041*b* of the piece 1041, whereas tuning of the third resonator 1300 may be effected by (at least) axially moving the common lid 1060 guided by the guiding means 350 arranged in a first axial end section 1041*a* of the piece 1041, as explained above with respect to FIG. 10.

According to further exemplary embodiments, it is also possible to provide a fixed first wall (not shown) instead of the lid 440 for the fourth resonator 1400.

According to further exemplary embodiments, at least one of said walls (e.g., first wall 120, 220, 320, 420 and/or side wall 130, 230, 330, 430 and/or common wall 1020 and/or further common wall 1021 and/or common side wall 1030 and/or further common side wall 1031) and or said lids (lid 140, 240, 340, 440 of a resonator and/or common lid 1060) of any of said resonators may comprise or be made of electrically conductive material such as copper, and/or may at least comprise an electrically conductive surface, e.g. a metallized surface.

Further exemplary embodiments relate to a filter for radio frequency, RF, signals comprising at least one resonator according to the embodiments and/or at least one apparatus according to the embodiments. Exemplary filters 2000, 2000' have already been explained above with reference to FIG. 9A, 9B.

Figure 12A:
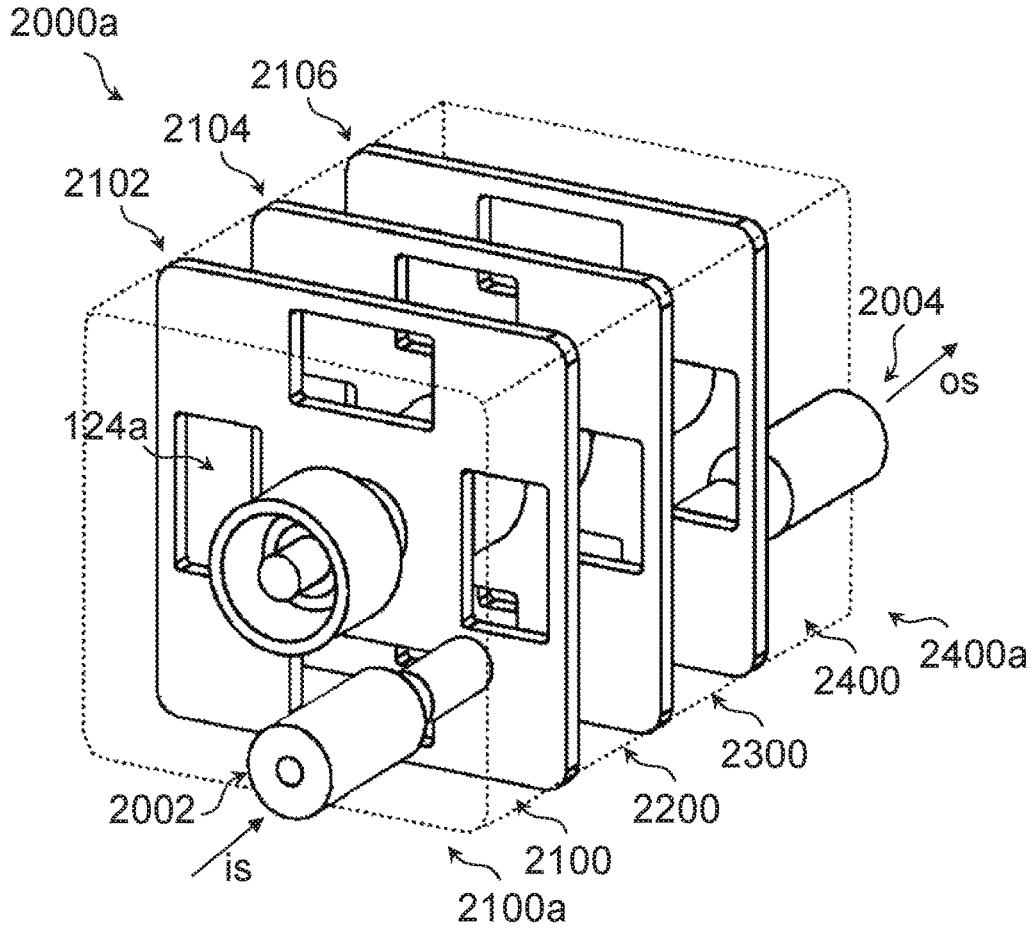

FIG. 12A schematically depicts a perspective view of a filter 2000*a* according to further exemplary embodiments. The filter 2000*a* comprises an input terminal 2002 for providing an RF input signal is to the filter 2000*a* and an output terminal 2004 where a filtered RF output signal os is provided. The filter 2000*a* further comprises four resonators 2100, 2200, 2300, 2400, wherein corresponding side walls (similar to side wall 130 of FIG. 1) are not depicted in FIG. 12A for the sake of clarity. Three common walls 2102, 2104, 2106 are depicted which (at least partly) separate the cavities of adjacent resonators from each other. As an example, common wall 2102 (at least partly) separates the cavities of the first and second resonators 2100, 2200 from each other.

According to further exemplary embodiments, at least one of said common walls 2102, 2104, 2106 comprises one or more openings 124*a*, . . . to enable coupling of RF energy between adjacent cavities, wherein said openings may be similar or identical to the openings 124*a*, 124*b*, 124*c*, 124*d* explained above with reference to FIG. 6B. According to further exemplary embodiments, by arranging the openings in a symmetric manner around the resonator ground and/or the longitudinal axis of the filter 2000*a*, the coupling between two resonators can be made independent of a rotation (or rotation angle) of individual resonators (and/or common walls) (which may, according to further embodiments be attained e.g. by a common lid 1060 (FIG. 10), wherein presently the wall 2104 may implement the function of the common lid 1060 of FIG. 10). Thus, if, according to further exemplary embodiments, rotation (e.g. of a lid 140, 1060) is employed to tune the resonant frequency of individual resonators, the (degree/amount of) coupling between adjacent resonators by means of said openings 124*a*, . . . , 124*d* is not affected by said rotation. Furthermore, in the case of more than two resonators, like in the filter 2000*a* of FIG. 12A, this method of coupling allows to reduce an amount of possible unwanted cross coupling that distorts a frequency response of the filter 2000*a*. These two features of the coupling method using said openings 124*a*, . . . , 124*d* according to further exemplary embodiments make this coupling particularly useful together with the principle of frequency tuning enabled by further exemplary embodiments.

According to further exemplary embodiments, the common walls 2102, 2104, 2106 of the filter 2000*a* of FIG. 12A may comprise a circular disc shape instead of the exemplarily depicted rounded rectangular shape of FIG. 12A. According to further exemplary embodiments, at least one of the common walls 2102, 2104, 2106 may be provided with an external thread (not shown) and/or a serrated surface, and at least one side wall (not shown) any of the resonators 2100, 2200, 2300, 2400 may comprise corresponding guiding means (not shown) that are configured to guide at least an axial movement of at least one of said common walls 2102, 2104, 2106 with respect to an adjacent cavity. According to further exemplary embodiments, at least one of the resonators 2100, 2400 may comprise at its respective axial end section 2100*a*, 2400*a* at least one lid 140 (FIG. 1) according to the embodiments.

According to further exemplary embodiments, guiding means comprising serrated surfaces 154 (FIG. 3) may be provided for the exemplarily depicted basically rectangular common walls 2102, 2104, 2106 of the filter 2000*a* of FIG. 12A.

Figure 12B:
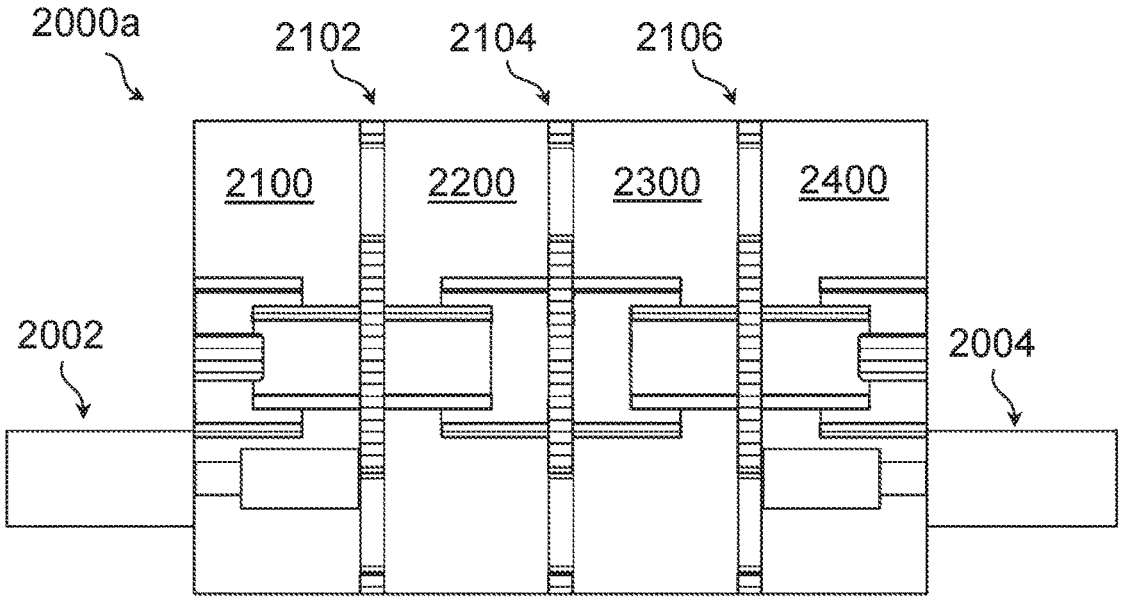

FIG. 12B schematically depicts a cross-sectional side view of the filter 2000*a* of FIG. 12A.

Figure 12C:
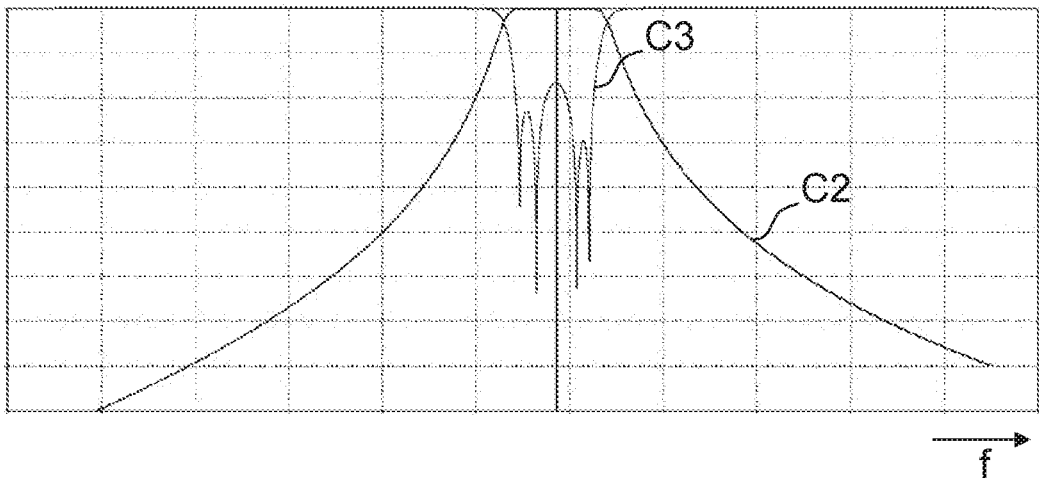

FIG. 12C schematically depicts operational parameters of the filter 2000*a* of FIG. 12A. Curve C2 depicts scattering parameter $S_{1,2}$ over frequency f, and curve C3 depicts scattering parameter $S_{2,2}$ over frequency f.

Figure 13:
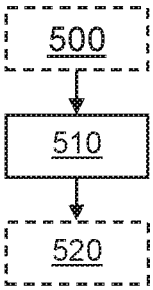

Further exemplary embodiments relate to a method of filtering a radio frequency, RF, signal, comprising passing said RF signal through a filter according to the embodiments. FIG. 13 schematically depicts a simplified flow-chart of a corresponding method according to further exemplary embodiments.

The method comprises a step 510 of passing an RF input signal is (FIG. 12A) through a filter 2000*a*. Step 510 e.g. comprises providing said RF input signal is to an input terminal 2002 of said filter 2000*a* and obtaining an output RF signal os, which corresponds to the filtered RF input signal, at an output terminal 2004 of said filter 2000*a*.

According to further exemplary embodiments, said method further comprises at least one optional step 500, 520 of tuning at least one resonator (e.g., its resonant frequency) of said filter 2000*a* by at least axially moving a lid 140 (FIG. 1) and/or a common lid 1060 or common wall 2102, 2104, 2106 adjacent to a cavity of said resonator with respect to said cavity facing said (common) lid.

According to further exemplary embodiments, the filter 2000 of FIG. 9A, which comprises four apparatus 1000*a* according to FIG. 8, may be tuned (steps 500, 520 of FIG. 12C) by moving any of the lids 140, 240 of its respective resonators. Thus, an efficient tuning of individual resonant frequencies of any of the eight resonators of said filter 2000 is enabled, which advantageously may also be performed in the field, e.g. when the filter 2000 is mounted in a target system such as a transceiver or an antenna for a communications system.

According to further exemplary embodiments, the tuning principle based on the (common) lid 140, 1060 may be applied to any type of cavity resonator, e.g. air-filled resonators and/or dielectric-filled resonators.

Further exemplary embodiments enable to provide resonators and filters for RF signals that comprise at least one of the following advantages: compact size, low cost, low loss, easily tunable, without sacrificing performance, enabling a compact integration with a target system such as an antenna and/or transceiver.

Further exemplary embodiments are particularly suited for use with 5G (fifth generation) communications systems, which are e.g. based on massive MIMO (multi-input multi-output) techniques that may require that one or two transceivers are provided per one or two or more antenna elements, which may drastically increase the number of transceivers required—as compared to other radio communications systems. According to further exemplary embodiments, in order to provide an antenna (system) with a great number of radiating elements closely spaced together, the transceivers supporting each antenna element may be physically placed behind each antenna element (with respect to a main direction of radiation, e.g. a main lobe of the antenna characteristic). In this context, according to further exemplary embodiments, RF filters for the antenna(s) may be physically arranged behind the radiating element(s) of the antenna(s), wherein such compact integration is facilitated by the RF resonators and RF filters according to further exemplary embodiments.

The invention claimed is:

1. An apparatus comprising:

a first resonator for radio frequency, RF, signals, with a cavity having a longitudinal axis, said first resonator comprising a first wall, at least one side wall, and a lid arranged opposite the first wall;

a second resonator for RF signals, with a respective cavity having a respective longitudinal axis, the second resonator comprising a respective first wall, at least one respective side wall, and a respective lid arranged opposite the respective first wall; and a third resonator for RF signals, with a corresponding cavity, said third resonator comprising at least one corresponding side wall and being arranged such that an axial end section of the corresponding cavity faces an axial end section of the respective cavity;

wherein said first resonator further comprises a guiding device arranged at said at least one side wall of said first resonator and configured to guide an axial movement of said lid of said first resonator along said longitudinal axis of said first resonator;

wherein the first wall of said first resonator and the respective first wall are adjacent to each other forming a common wall which at least partly separates the cavity of said first resonator and the respective cavity from each other; and wherein a common lid is provided between said second resonator and said third resonator, said common lid at least partly covering the respective cavity and the corresponding cavity and being movable along the respective longitudinal axis.

2. The apparatus according to claim 1, wherein said common wall has at least one opening therein.

3. The apparatus according to claim 1, wherein said at least one side wall of said first resonator and said at least one respective side wall are made of one piece forming a common side wall for both said cavity of said first resonator and said respective cavity.

4. The apparatus according to claim 1, wherein said apparatus further comprises a fourth resonator for RF signals, which is coupled with said third resonator.

5. The apparatus according to claim 1, wherein said guiding device comprises a first thread, and wherein said lid of said first resonator comprises a second thread that fits to said first thread of said guiding device.

6. The apparatus according to claim 1, wherein said guiding device comprises a first serrated surface, and wherein said lid of said first resonator comprises a second serrated surface that fits to said first serrated surface of said guiding device.

7. The apparatus according to claim 1, wherein said guiding device is arranged in a first axial end section of said cavity of said first resonator, and wherein said first wall is arranged in a second axial end section of said cavity of said first resonator.

8. A filter for radio frequency, RF, signals comprising at least one apparatus, said at least one apparatus comprising:

a first resonator for, RF signals, with a cavity having a longitudinal axis, said first resonator comprising a first wall, at least one side wall, and a lid arranged opposite the first wall;

a second resonator for RF signals, with a respective cavity having a respective longitudinal axis, the second resonator comprising a respective first wall, at least one respective side wall, and a respective lid arranged opposite the respective first wall; and a third resonator for RF signals, with a corresponding cavity, said third resonator comprising at least one corresponding side wall and being arranged such that an axial end section of the corresponding cavity faces an axial end section of the respective cavity;

wherein said first resonator further comprises a guiding device arranged at said at least one side wall of said first resonator and is configured to guide an axial movement of said lid of said first resonator along said longitudinal axis of said first resonator;

wherein the first wall of the said first resonator and the respective first wall are adjacent to each other forming a common wall which at least partly separates the cavity of said first resonator and the respective cavity of the second resonator from each other; and wherein a common lid is provided between said second resonator and said third resonator, said common lid at least partly covering the respective cavity and the corresponding cavity and being movable along the respective longitudinal axis.

9. The filter according to claim 8, wherein said at least one side wall of said first resonator and said at least one respective side wall are made of one piece forming a common side wall for both said cavity of said first resonator and said respective cavity.

10. The filter according to claim 8, wherein said apparatus further comprises a fourth resonator for RF signals, which is coupled with said third resonator.

* * * * *